US010157562B2

(12) United States Patent
Shin et al.

(10) Patent No.: US 10,157,562 B2
(45) Date of Patent: Dec. 18, 2018

(54) DRIVER INTEGRATED CIRCUIT (IC) CHIP AND DISPLAY DEVICE HAVING THE SAME

(71) Applicant: SAMSUNG DISPLAY CO., LTD., Yongin-si, Gyeonggi-do (KR)

(72) Inventors: Byung-Hyuk Shin, Seoul (KR); Myeong-Bin Lim, Hwaseong-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 140 days.

(21) Appl. No.: 15/141,881

(22) Filed: Apr. 29, 2016

(65) Prior Publication Data

US 2017/0076694 A1 Mar. 16, 2017

(30) Foreign Application Priority Data

Sep. 15, 2015 (KR) ..... 10-2015-0130119

(51) Int. Cl.
*G09G 5/10* (2006.01)
*G09G 3/20* (2006.01)

(52) U.S. Cl.
CPC ... *G09G 3/2003* (2013.01); *G09G 2300/0426* (2013.01); *G09G 2300/0452* (2013.01); *G09G 2310/027* (2013.01); *G09G 2320/0276* (2013.01); *G09G 2330/028* (2013.01)

(58) Field of Classification Search
USPC ... 345/208, 211, 98, 690, 691, 87, 209, 212, 345/100, 89; 349/106
See application file for complete search history.

(56) References Cited

U.S. PATENT DOCUMENTS

2002/0050970 A1* 5/2002 Kajihara ..... G09G 3/2011 345/89
2002/0063666 A1* 5/2002 Kang ..... G09G 3/2092 345/87
2003/0071778 A1* 4/2003 Lee ..... G09G 3/2011 345/98
2003/0071779 A1* 4/2003 Lee ..... G09G 3/2011 345/99
2003/0071943 A1* 4/2003 Choo ..... G02F 1/133514 349/106
2004/0113923 A1* 6/2004 Ha ..... G09G 3/3208 345/690
2005/0168490 A1* 8/2005 Takahara ..... G09G 3/2014 345/690
2006/0262067 A1* 11/2006 Ha ..... G09G 3/3611 345/98

(Continued)

FOREIGN PATENT DOCUMENTS

KR 10-2008-0003096 A 1/2008
KR 10-2010-0099946 A 9/2010

(Continued)

*Primary Examiner* — Thuy Pardo
(74) *Attorney, Agent, or Firm* — Lee & Morse, P.C.

(57) ABSTRACT

A driver integrated circuit (IC) chip includes gamma voltage generators, a line selector, and a data driver. The gamma voltage generators generate gamma voltage sets based on a reference voltage set. The line selector controls the connection between a plurality of voltage line sets for providing the reference voltage set and the gamma voltage generators based on a selection signal. The data driver converts input image data to data signals based on the gamma voltage sets.

13 Claims, 12 Drawing Sheets

(56) References Cited

U.S. PATENT DOCUMENTS

| | | | | |
|---|---|---|---|---|
| 2007/0035506 | A1* | 2/2007 | Lee | G09G 3/2011 345/100 |
| 2008/0170027 | A1* | 7/2008 | Kyeong | G09G 3/3688 345/100 |
| 2009/0015574 | A1* | 1/2009 | Kim | G09G 3/3688 345/208 |
| 2009/0184984 | A1* | 7/2009 | Takahara | G09G 3/2014 345/690 |
| 2009/0189924 | A1* | 7/2009 | Ogura | G09G 3/3233 345/690 |
| 2010/0060621 | A1* | 3/2010 | Hsu | G09G 3/2092 345/211 |
| 2010/0265277 | A1* | 10/2010 | Takahara | G09G 3/2014 345/690 |
| 2011/0128215 | A1* | 6/2011 | Chang | G09G 3/3648 345/98 |
| 2013/0147861 | A1* | 6/2013 | Kim | G09G 5/10 345/690 |
| 2013/0300781 | A1* | 11/2013 | Lee | G09G 3/3406 345/691 |
| 2015/0188431 | A1* | 7/2015 | Cho | G09G 3/2003 345/212 |
| 2016/0071455 | A1* | 3/2016 | Jung | G09G 3/20 345/209 |
| 2016/0163277 | A1* | 6/2016 | Ludden | G09G 3/3688 345/690 |

FOREIGN PATENT DOCUMENTS

| | | | |
|---|---|---|---|
| KR | 10-1050693 | B1 | 7/2011 |
| KR | 10-2013-0005966 | A | 1/2013 |

* cited by examiner

DRIVER INTEGRATED CIRCUIT (IC) CHIP AND DISPLAY DEVICE HAVING THE SAME

CROSS REFERENCE TO RELATED APPLICATION

Korean Patent Application No. 10-2015-0130119, filed on Sep. 15, 2015, and entitled, "Driver Integrated Circuit (IC) Chip and Display Device Having the Same," is incorporated by reference herein in its entirety.

BACKGROUND

1. Field

One or more embodiments herein relate to a driver IC chip and a display device having a driver IC chip.

2. Description of the Related Art

A driving IC chip may be used to generate driving signals for driving a display panel based on input image data. One type of driving IC chip includes a gamma voltage generator generating a gamma voltage set based on a reference voltage set and a data driver converting the input image data into a data signal based on the gamma voltage set.

Meanwhile, the driving chip is connected to the display panel by a chip on glass (COG) manner, a chip on film (COF) manner, or a tape carrier package (TCP) manner, etc. When the gamma voltage generator receives a plurality of reference voltage sets via adhesive pads and generates gamma voltage sets for color lights that are different from each other based on the reference voltage sets, the number of adhesive pads for bonding the COF film and the PCB is determined according to the predetermined number of reference voltage sets. In this case, a distance between the adhesive pads can decrease and a bonding defect of adhesive pads the can occur.

SUMMARY

In accordance with one or more embodiments, a driver integrated circuit (IC) chip includes a plurality of gamma voltage generators to generate a plurality of gamma voltage sets based on a reference voltage set; a line selector to control a connection between a plurality of voltage line sets for providing the reference voltage set and the gamma voltage generators based on a selection signal; and a data driver to convert input image data to data signals based on the gamma voltage sets.

The gamma voltage generators may include a first gamma voltage generator to generate a first gamma voltage set for first color light; a second gamma voltage generator to generate a second gamma voltage set for second color light; and a third gamma voltage generator to generate a third gamma voltage set for third color light. The line selector may include a first switch between a first voltage line set of the voltage line sets and the second gamma voltage generator, the first switch to be turned-on in response to the selection signal; and a second switch between a second voltage line set of the voltage line sets and the second gamma voltage generator, the second switch to be turned-off in response to the selection signal. The first through third colors of light may be red, green, and blue respectively.

The gamma voltage generators may include a fourth gamma voltage generator to generate a fourth gamma voltage set for fourth color light. The line selector may include a first switch between a first voltage line set of the voltage line sets and the second gamma voltage generator, the first switch to be turned-on in response to a first selection signal; a second switch between a second voltage line set of the voltage line sets and the second gamma voltage generator, the second switch to be turned-off in response to the first selection signal; a third switch between a third voltage line set of the voltage line sets and the fourth gamma voltage generator, the third switch to be turned-on a second selection signal; and a fourth switch between a fourth voltage line set of the voltage line sets and the fourth gamma voltage generator, the fourth switch to be turned-off the second selection signal. The first through fourth colors of light may be red, green, blue, and white respectively. The selection signal may be included in protocol data for receiving the input image data.

In accordance with one or more other embodiments, a display device includes a display panel including a plurality of pixels; a driver integrated circuit (IC) chip to drive the display panel; and a power supply to provide at least one reference voltage set to the driver IC chip, wherein the driver IC chip includes: a plurality of gamma voltage generators to generate a plurality of gamma voltage sets based on the reference voltage set; a line selector to control a connection between a plurality of voltage line sets for providing the reference voltage set and the gamma voltage generators; and a data driver to convert input image data to a data signal based on the gamma voltage sets.

The power supply may be on a printed circuit board (PCB), and the driver IC chip may be connected to the display panel and the PCB by a tape carrier package (TCP) manner or a chip-on-film (COF) manner. The display device may include a provision voltage line set connected to the gamma voltage generators among the voltage line sets is bonded to the PCB, and a non-provision voltage line set disconnected from the gamma voltage generators among the voltage line sets is not bonded to the PCB.

The line selector may controls the connection between the voltage line sets and the gamma voltage generators based on a selection signal. The gamma voltage generators may include a first gamma voltage generator to generate a first gamma voltage set for first color light; a second gamma voltage generator to generate a second gamma voltage set for second color light; and a third gamma voltage generator to generate a third gamma voltage set for third color light.

The line selector may include a first switch between a first voltage line set of the voltage line sets and the second gamma voltage generator, the first switch to be turned-on in response to the selection signal; and a second switch between a second voltage line set of the voltage line sets and the second gamma voltage generator, the second switch to be turned-off in response to the selection signal. The first through third colors of light may include red, green, and blue respectively.

The gamma voltage generators may include a fourth gamma voltage generator to generate a fourth gamma voltage set for fourth color light. The line selector may include a first switch between a first voltage line set of the voltage line sets and the second gamma voltage generator, the first switch to be turned-on in response to a first selection signal; a second switch between a second voltage line set of the voltage line sets and the second gamma voltage generator, the second switch to be turned-off in response to the first selection signal; a third switch between a third voltage line set of the voltage line sets and the fourth gamma voltage generator, the third switch to be turned-on a second selection signal; and a fourth switch between a fourth voltage line set of the voltage line sets and the fourth gamma voltage generator, the fourth switch to be turned-off the second selection signal. The first through fourth colors of light may be red, green, blue, and white respectively.

The selection signal may be included in protocol data for receiving the input image data. Each of the gamma voltage generators may include a resistance string to generate one of the gamma voltage sets by distributing the reference voltage set.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
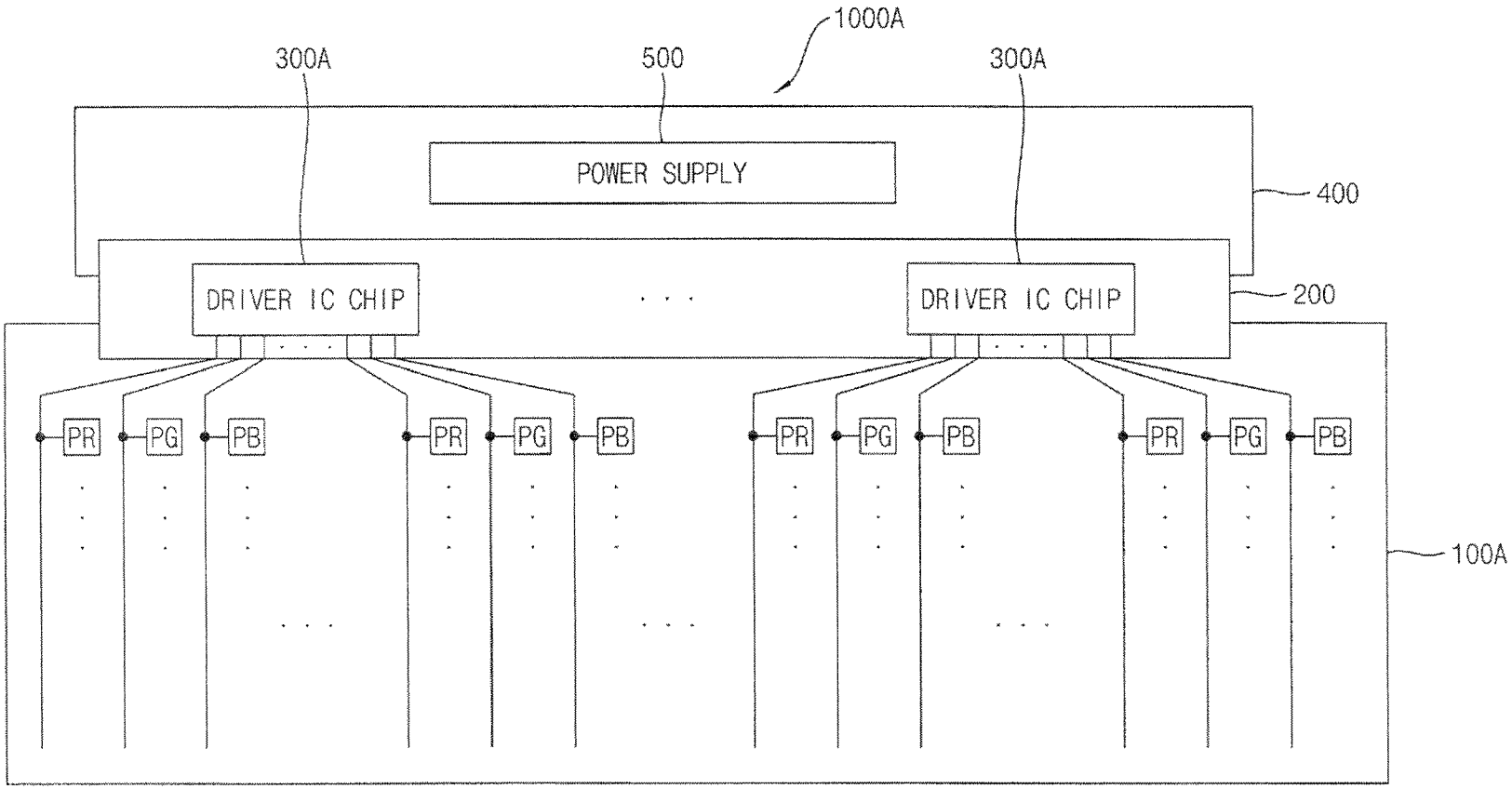
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 1000A which includes a display panel 100A, at least one driver IC chip 300A, and a power supply 500. The display panel 100A includes a plurality of pixels. Each pixel may include a plurality of sub-pixels. For example, in one embodiment, each pixel may include a red sub-pixel PR emitting red light, a green sub-pixel PG emitting green light, and a blue sub-pixel PB emitting blue light. The red, green, and blue sub-pixels PR, PG, and PB are arranged in a predetermined pattern, e.g., a stripe pattern or another pattern. Each pixel may include a different combination of color sub-pixels in another embodiment.

The at least one driver IC chip 300A generates driving signals for driving the display panel 100A. For example, each driver IC chip 300A may provide a scan signal to the sub-pixels via a plurality of scan lines and data signals to the sub-pixels via a plurality of data lines. In one example embodiment, each driver IC chip 300A may be connected to the display panel 100A and a printed circuit board (PCB) 400, for example, in a tape carrier package (TCP) manner or a chip-on-film (COF) manner. In FIG. 1, two driver IC chips 300A are illustratively shown for generating driving signals. Also, in FIG. 1, the driver IC chip 300A is illustratively shown as being mounted on a COF film 200 that is bonded to the display panel 100A and the PCB 400.

In one embodiment, each driver IC chip 300A may generate a plurality of gamma voltage sets based on one or more reference voltage sets. For example, each driver IC chip 300A may include a plurality of gamma voltage generators that respectively receive a plurality of reference voltage sets. In another embodiment, some of the gamma voltage generators may share a reference voltage set in order to generate gamma voltage sets. Each driver IC chip 300A may convert input image data to a data signal based on the gamma voltage sets, and then output the data signal to the sub-pixels.

In one example embodiment, each driver IC chip 300A may include a plurality of gamma voltage generators for generating the gamma voltage sets based on one or more reference voltage sets, a line selector for controlling a connection between a plurality of voltage line sets that provide the one or more reference voltage sets and the gamma voltage generators, and a data driver for converting the input image data to data signals using the gamma voltage sets.

The power supply 500 may provide at least one reference voltage set to each driver IC chip 300A. In one example embodiment, the power supply 500 may generate a first reference voltage set for red color light, a second reference voltage set for green color light, and a third reference voltage set for blue color light. The first through third reference voltage sets are then provided to each driver IC chip 300A. In another example embodiment, the power supply 500 may generate a fifth reference voltage set for red color light and green color light and the third reference voltage set for blue color light, and may then provide the third and fifth reference voltage sets to each driver IC chip 300A. In one example embodiment, power supply 500 may be formed in the PCB 400.

Therefore, in the display device 1000A, the gamma voltage generators respectively receive a plurality of reference voltage sets, or some of the gamma voltage generators share a reference voltage set, to generate the gamma voltage sets. For example, when deviations between or among the gamma voltage sets for red color light, green color light, and blue color light are relatively large (e.g., above one or more predetermined values), the display device 1000A may generate the gamma voltage sets using first through third reference voltage sets respectively corresponding to the red, green, and blue color light. On the other hand, when the deviation between the gamma voltage sets for the red and green color is relatively small (e.g., below a predetermined value), the display device 1000A may generate the gamma voltage sets using a fifth reference voltage set corresponding to the red and green color light and the third reference voltage set corresponding to the blue color light.

In this case, the display device 1000A may decrease the number of adhesive pads between the COF film 200 in which each driver IC chip 300A is formed and the PCB 400 in which the power supply 500 is formed, and may increase distances between the adhesive pads. Therefore, the display device 1000A may prevent a bonding defect of the adhesive pads and improve a production yield.

Figure 2:
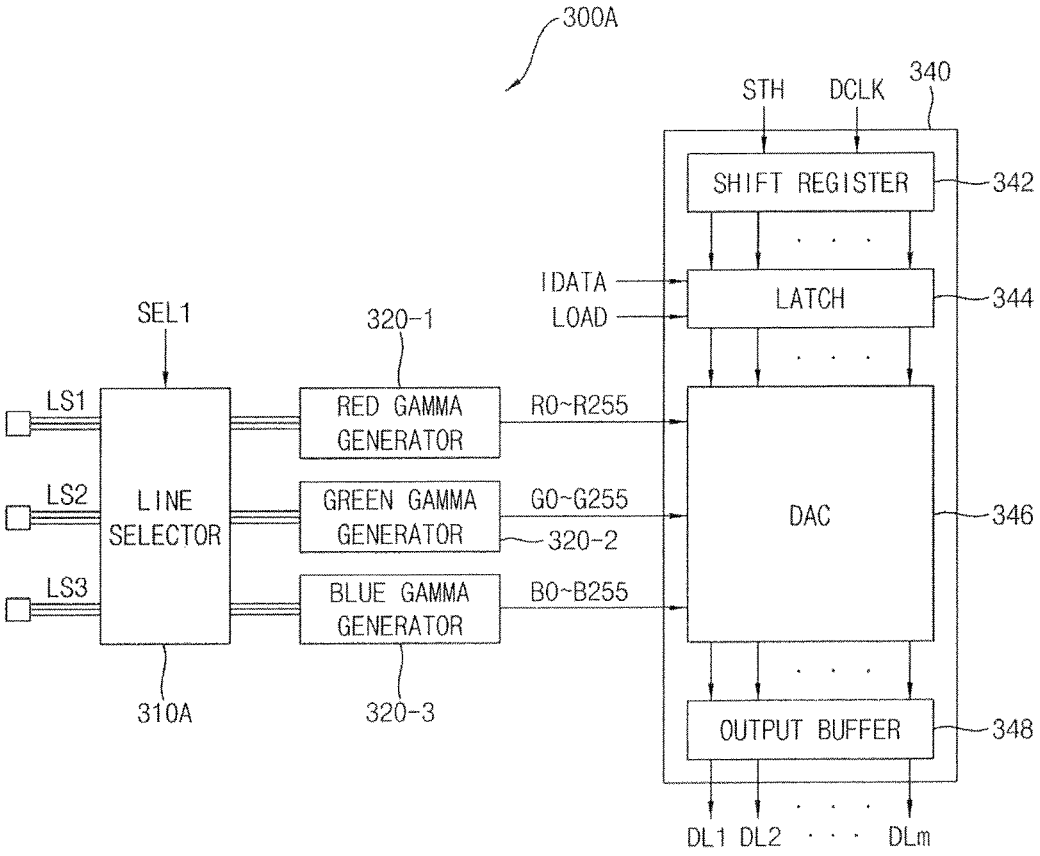
FIG. 2 illustrates an embodiment of a driver IC chip.

FIG. 2 illustrates an embodiment of a driver IC chip 300A, which, for example, may be representative of the driver IC chips in the display device of FIG. 1. Referring to FIG. 2, the driver IC chip 300A includes a line selector 310A, a plurality of gamma voltage generators 320-1 through 320-3, and a data driver 340.

The line selector 310A may control the connection between voltage line sets LS1 through LS3 and gamma voltage generators 320-1 through 320-3 based on a selection signal SEL1 Thus, the line selector 310A controls the connection between the voltage line sets LS1 through LS3 and the gamma voltage generators 320-1 through 320-3 such that the gamma voltage generators 320-1 through 320-3 respectively receive a plurality of reference voltage sets or gamma voltage generators share a reference voltage set. In one example embodiment, the line selector 310A may include a first switch between a first voltage line set LS1 and the second gamma voltage generator 320-2. The first switch may be turned-on in response to the selection signal SEL1. The line selector 310A may include a second switch between a second voltage line set LS2 and the second gamma voltage generator 320-2. The second switch may be turned-off in response to the selection signal SEL1.

Each of the gamma voltage generators 320-1 through 320-3 may generate a gamma voltage set based on a reference voltage set. In one example embodiment, the gamma voltage generators 320-1 through 320-3 include the first gamma voltage generator 320-1 for generating a first gamma voltage set R0 through R255 for red color light, a second gamma voltage generator 320-2 for generating a second gamma voltage set G0 through G255 set for green color light, and a third gamma voltage generator 320-3 for generating a third gamma voltage set B0 through B155 for blue color light. In one example embodiment, each of the gamma voltage generators 320-1 through 320-3 may include a resistance string for generating one of the gamma voltage sets by distributing the reference voltage set.

The data driver 340 may convert input image data to data signals based on the gamma voltage sets. In one example embodiment, the data driver 340 may include a shift register 342, a latch circuit 344, a digital-analog converter 346, and an output buffer 348.

The shift register 342 may receive a horizontal start signal STH and a data clock signal DCLK from a controller. The shift register 342 may shift the horizontal start signal STH for synchronizing the data clock signal DCLK to generate a sampling signal.

The latch circuit 344 may latch input image data IDATA in response to the sampling signal, and may output the latched input image data in response to a load signal LOAD.

The digital-analog converter 346 may convert the latched input image data to data signals based on the first gamma voltage set R0 through R255, the second gamma voltage set G0 through G255, and the third gamma voltage set B0 through B255. For example, the digital-analog converter 346 may convert red color image data to the data signal based on the first gamma voltage set R0 through R255. The digital-analog converter 346 may convert green color image data to the data signal based on the second gamma voltage set G0 through G255. The digital-analog converter 346 may convert blue color image data to the data signal based on the third gamma voltage set B0 through B255. The output buffer 348 may provide the data signals to the data lines DL1 through DLm. The data driver 340 may have a different structure in another embodiment.

Figure 3:
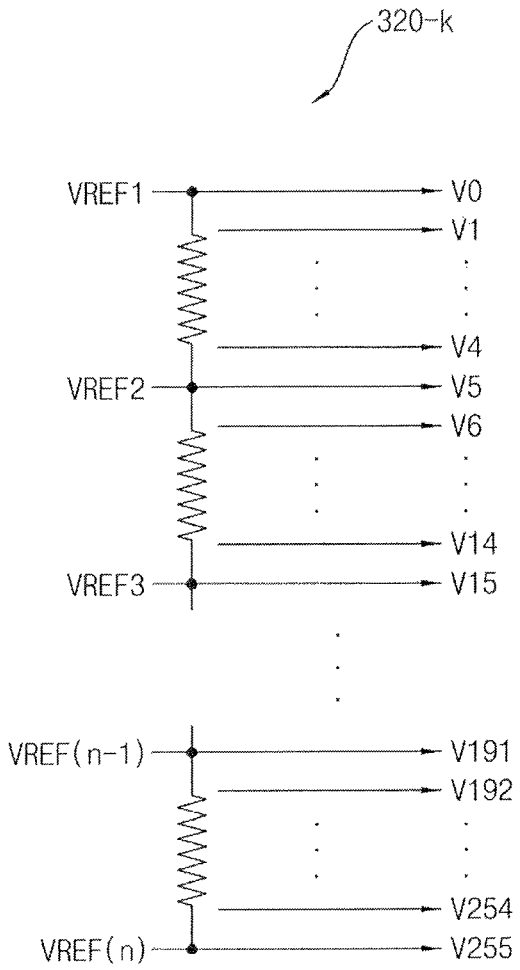
FIG. 3 illustrates an embodiment of a gamma voltage generator.

FIG. 3 illustrates an embodiment of a gamma voltage generator 320-k, which, for example, may be in the driver IC chip of FIG. 2. Referring to FIG. 3, the gamma voltage generator 320-k may include a resistance string for generating one of the gamma voltage sets by distributing the reference voltage set. For example, a first reference voltage VREF1 through a (N)th reference voltage VREFn may be applied to the resistance string as a reference voltage set. The resistance string may distribute the first reference voltage VREF1 through the (N)th reference voltage VREFn, thereby non-linearly generating (0)th through (255)th grayscale gamma voltages V0 through V255 as the gamma voltage set, e.g., gamma curve. The gamma voltage generator 320-k may have a different structure in another embodiment.

FIGS. 4A to 5B illustrate various embodiments of driver IC chips 300A and 300B that may be included in FIG. 2. Referring to FIGS. 4A to 5B, the driver IC chips 300A-1/300A-2 may be mounted on the display device providing the reference voltage sets in a variety of methods.

In one example embodiment, the driver IC chip 300A-1/300A-2 may be mounted on the display device providing a first reference voltage set VR1 through VRn for red color light, a second reference voltage set VG1 through VGn for green color light, and a third reference voltage set VB1 through VBn for blue color light in order to generate gamma voltage sets.

In another example embodiment, the driver IC chip 300A-1/300A-2 may be mounted on the display device providing a fifth reference voltage set VRG1 through VRGn for red color light and green color light and the third reference voltage set VB1 through VGn for blue color light in order to generate gamma voltage sets.

The driver IC chip 300A-1/300A-2 may receive a selection signal SEL1. In the driver IC chip 300A-1/300A-2, the gamma voltage generators respectively receive the reference voltage sets or some of the gamma voltage generators share the reference voltage set based on the selection signal SEL1 In one example embodiment, the driver IC chip 300A-1/300A-2 may receive a selection signal SEL1 via a selection signal adhesive pad like in FIGS. 4A and 4B.

Figure 5A:
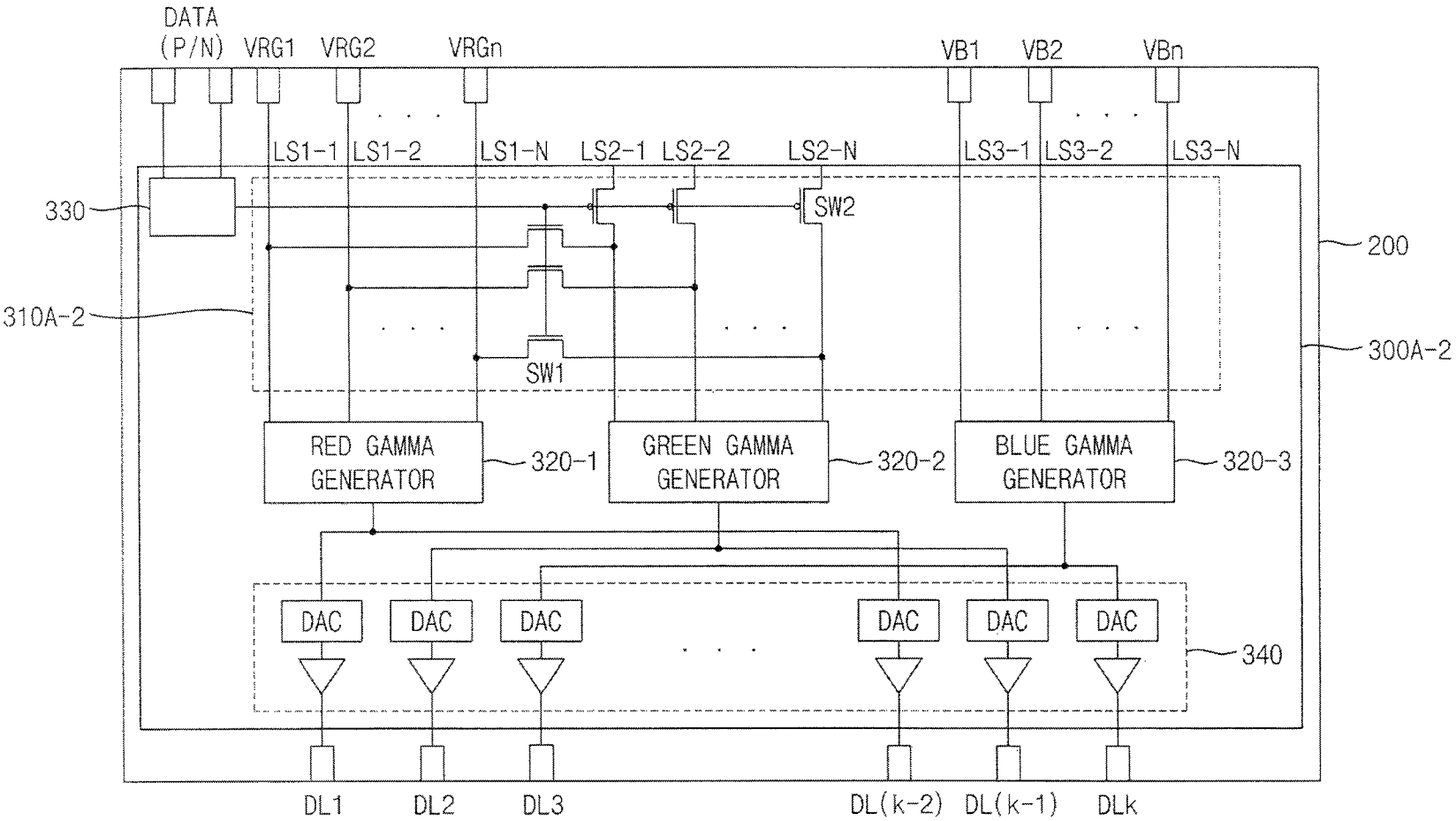
Figure 5B:
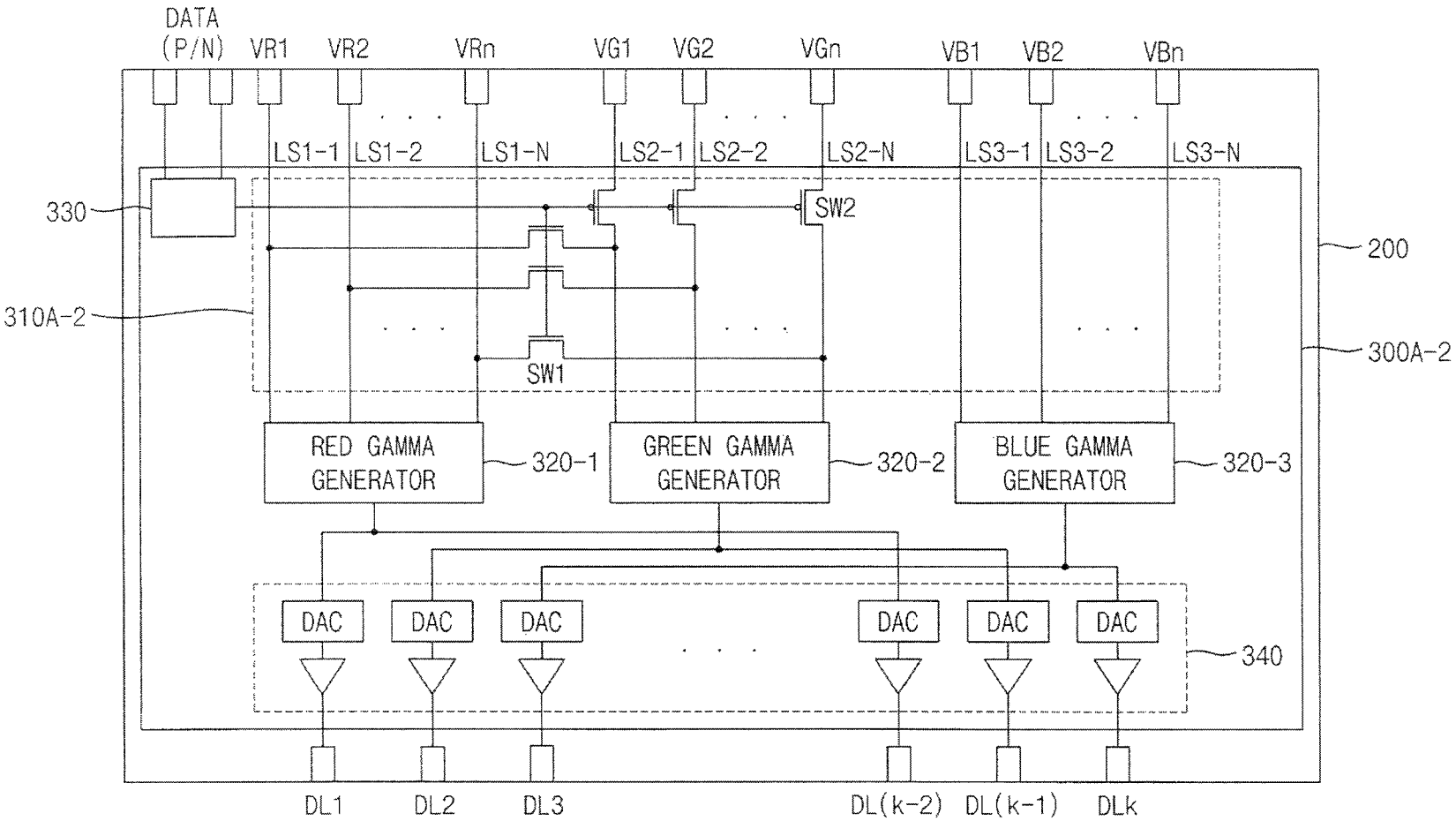

In another example embodiment, the selection signal SEL1 may be included in a protocol data for receiving the input image data, and the driver IC chip 300A-1/300A-2 may receive a selection signal SEL1 via a protocol data adhesive pad like in FIGS. 5A and 5B. When the selection signal SEL1 may be included in the protocol data, the driver IC chip 300A-1/300A-2 may receive the selection signal SEL1 without an additional adhesive pad for receiving the selection signal SEL1.

Figure 4A:
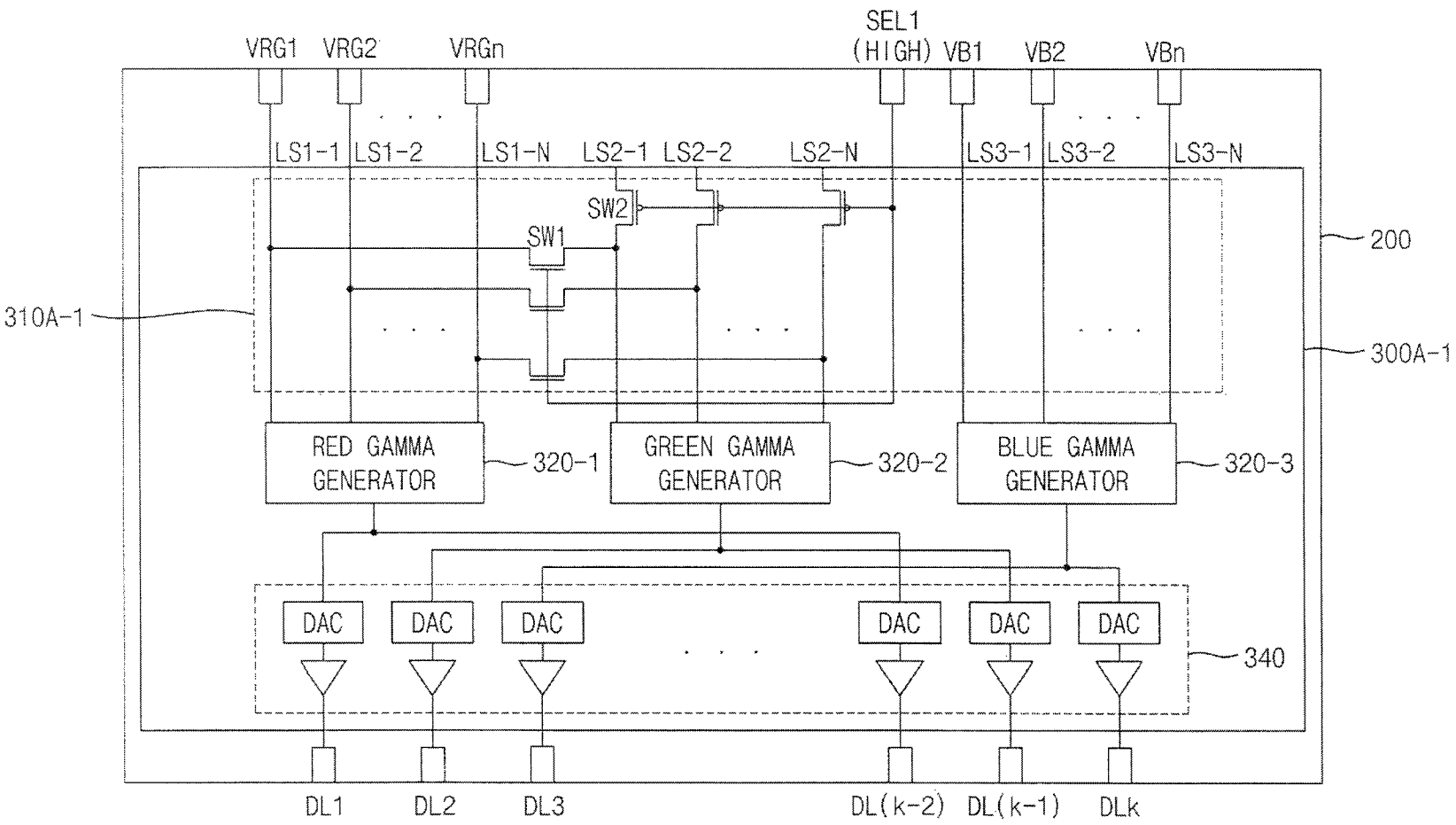
FIGS. 4A-5B illustrate embodiments of a driver IC chip for a display device.

As shown in FIG. 4A, the driver IC chip 300A-1 may be mounted on a display device providing the fifth reference voltage set VRG1 through VRGn for red and green color light and the third reference voltage set VB1 through VGn for blue color light in order to generate gamma voltage sets. The driver IC chip 300A-1 may be mounted on the display device, for example, by the COF manner.

The power supply may provide the third reference voltage set VB1 through VBn and the fifth reference voltage set VRG1 through VRGn to the driver IC chip 300A-1 via a PCB in which the power supply is formed and a COF film 200 in which the driver IC chip 300A-1 is formed. In this case, the number of reference voltage adhesive pads for bonding the COF film 200 and the PCB may be about two times greater than the number of the reference voltages in one reference voltage set. For example, the third reference voltage set VB1 through VBn and the fifth reference voltage set VRG1 through VRGn may respectively include 11 reference voltages. Then, the total number of the reference voltage adhesive pads may be 22.

The line selector 310A-1 may include a first switch SW1 and a second switch SW2. The first switch SW1 may be between a first voltage line set LS1-1 through LS1-N and the second gamma voltage generator 320-2. The first switch SW1 may be turned-on in response to the selection signal SEL1. The second switch SW2 may be between a second voltage line set LS2-1 through LS-n and the second gamma voltage generator 320-2. The second switch SW2 may be turned-off in response to the selection signal SEL1.

The selection signal SEL1 may be set to a first level (e.g., a high level) such that the fifth reference voltage set VRG1 through VRGn may be provided to the first gamma voltage generator 320-1 and the second gamma voltage generator 320-2. The first switch SW1 may be turned-on, and the second switch element SW2 may be turned-off based on the selection signal SEL1. Therefore, the line selector 310A-1 may connect the first voltage line set LS1-1 through LS1-N to the first and second gamma voltage generators 320-1 and 320-2. The line selector 310A-1 may disconnect the second voltage line set LS2-1 through LS2-N from the second gamma voltage generator 320-2. Also, the line selector 310A-1 may connect the third voltage line set LS3-1 through LS3-N to the third gamma voltage generator 320-3.

Figure 4B:
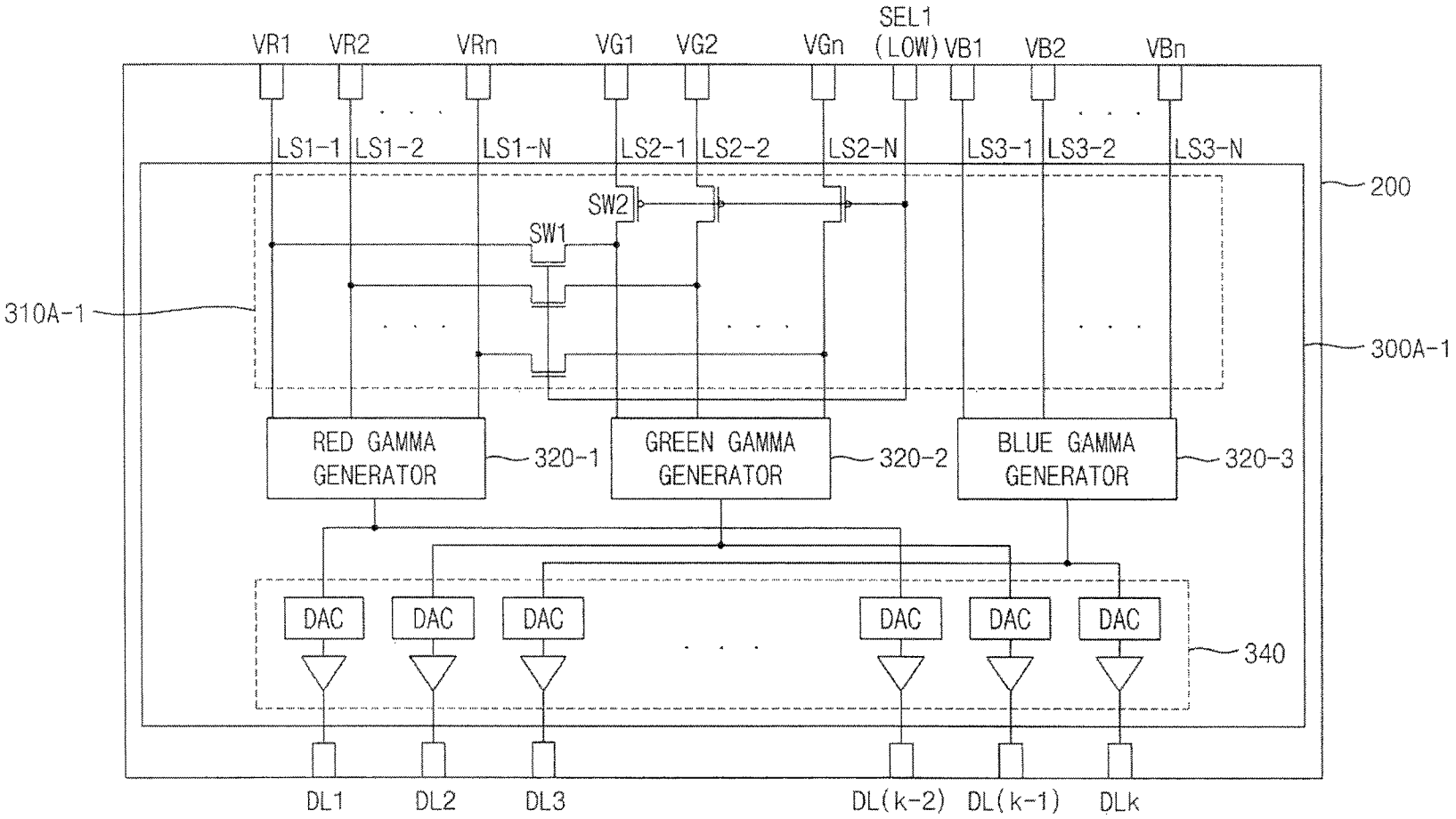

As illustrated in FIG. 4B, the driver IC chip 300A-1 may be mounted on a display device providing a first reference voltage set VR1 through VRn for red color light, a second reference voltage set VG1 through VGn for green color light, a third reference voltage set VB1 through VBn for blue color light in order to generate gamma voltage sets. The driver IC chip 300A-1 may be mounted on a display device, for example, by the COF manner.

The power supply may provide the first reference voltage set VR1 through VRn, the second reference voltage set VG1 through VGn, and the third reference voltage set VB1 through VBn to the driver IC chip 300A-1 via a PCB, which includes the power supply and COF film 200 in which the driver IC chip 300A-1 is formed. In this case, the number of reference voltage adhesive pads for bonding the COF film 200 and the PCB may be about three times greater than the number of the reference voltages in one reference voltage set. For example, the first reference voltage set VR1 through VRn, the second reference voltage set VG1 through VGn, and the third reference voltage set VB1 through VBn may respectively include 11 reference voltages. Then, the total number of the reference voltage adhesive pads may be 33.

The line selector 310A-1 may include a first switch SW1 and a second switch SW2. The first switch SW1 may be between a first voltage line set LS1-1 through LS1-N and the second gamma voltage generator 320-2. The first switch SW1 may be turned-on in response to the selection signal SEL1. The second switch SW2 may be between a second voltage line set LS2-1 through LS-n and the second gamma voltage generator 320-2. The second switch SW2 may be turned-off in response to the selection signal SEL1.

The selection signal SEL1 may be set to a second level (e.g., a low level) such that the first reference voltage set VR1 through VRn may be provided to the first gamma voltage generator 320-1, and the second reference voltage set VG1 through VGn may be provided to the second gamma voltage generator 320-2. The first switch SW1 may be turned-off and the second switch SW2 may be turned-on based on the selection signal SEL1. Therefore, the line selector 310A-1 may connect the first voltage line set LS1-1 through LS1-N to the first gamma voltage generator 320-1. The line selector 310A-1 may connect the second voltage line set LS2-1 through LS2-N to the second gamma voltage generator 320-2. Also, the line selector 310A-1 may connect the third voltage line set LS3-1 through LS3-N to the third gamma voltage generator 320-3.

As shown in FIG. 5A, the driver IC chip 300A-2 may be mounted on a display device providing a fifth reference voltage set VRG1 through VRGn for red color light and green color light and the third reference voltage set VB1 through VGn for blue color light in order to generate gamma voltage sets. The driver IC chip 300A-2 may be mounted on a display device, for example, by the COF manner. The driver IC chip 300A-2 according to the present exemplary embodiment may be substantially the same as the driver IC chip of the exemplary embodiment in FIG. 4A, except that the selection signal is received through protocol data for receiving the input image data.

The line selector 310A-2 may include a first switch SW1 and a second switch SW2. The first switch SW1 may be between a first voltage line set LS1-1 through LS1-N and the second gamma voltage generator 320-2. The first switch SW1 may be turned-on in response to the selection signal. The second switch SW2 may be between a second voltage line set LS2-1 through LS-n and the second gamma voltage generator 320-2. The second switch SW2 may be turned-off in response to the selection signal.

The selection signal may be included in protocol data for receiving the input image data. The protocol data may be received via a protocol data adhesive pad, and the selection signal in the protocol data may be interpreted to a first level (e.g., high level) by a logic gate 330. Therefore, the line selector 310A-2 may connect the first voltage line set LS1-1 through LS1-N to the first and second gamma voltage generators 320-1 and 320-2. The line selector 310A-2 may disconnect the second voltage line set LS2-1 through LS2-N from the second gamma voltage generator 320-2. Also, the line selector 310A-2 may connect the third voltage line set LS3-1 through LS3-N to the third gamma voltage generator 320-3.

As shown in FIG. 5B, the driver IC chip 300A-2 may be mounted on a display device providing a first reference voltage set VR1 through VRn for red color light, a second reference voltage set VG1 through VGn for green color light, and a third reference voltage set VB1 through VBn for blue color light in order to generate gamma voltage sets. The driver IC chip 300A-2 may be mounted on a display device, for example, by the COF manner. The driver IC chip 300A-2 according to the present exemplary embodiment may be substantially the same as the driver IC chip of the exemplary embodiment in FIG. 4B.

The selection signal may be included in protocol data for receiving the input image data. The protocol data may be received via a protocol data adhesive pad, and the selection signal in the protocol data may be interpreted to a second level (e.g., low level) by the logic gate 330. Therefore, the line selector 310A-2 may connect the first voltage line set LS1-1 through LS1-N to the first gamma voltage generator 320-1. The line selector 310A-2 may connect the second voltage line set LS2-1 through LS2-N to the second gamma voltage generator 320-2. Also, the line selector 310A-2 may connect the third voltage line set LS3-1 through LS3-N to the third gamma voltage generator 320-3.

Figure 6:
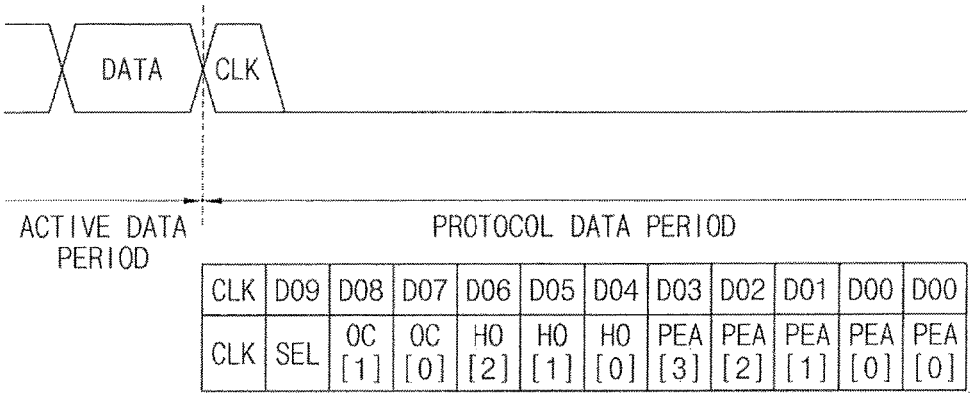
FIG. 6 illustrates an example of protocol data for transferring input image data.

FIG. 6 illustrates an example of the protocol data for transferring input image data. Referring to FIG. 6, the selection signal SEL may be included in the protocol data for receiving the input image data. In this embodiment, the protocol includes a protocol data period in which protocol data is received between active data periods in which input image data is received. The protocol data may have, for example, a first value PEA for setting a peak voltage of the data signal, a second value HO for adjusting the output time of the data signal, the selection signal SEL, and/or another signal. Therefore, the driver IC chip may receive the selection signal in the protocol data.

Figure 7:
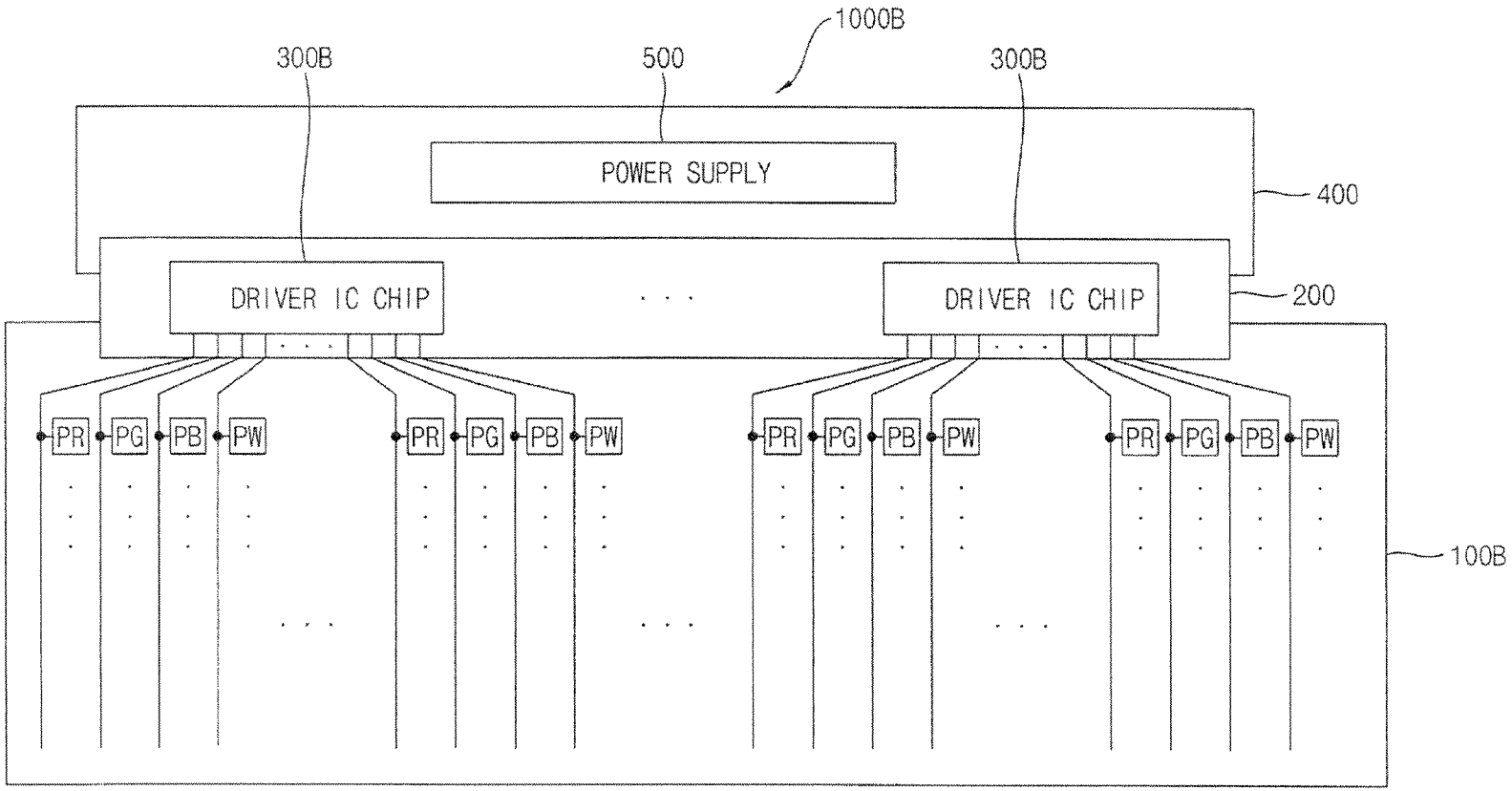
FIG. 7 illustrates another embodiment of a display device.

FIG. 7 illustrates another embodiment of a display device 1000B which includes a display panel 100B, a driver IC chip 300B, and a power supply 500. The display device 1000B according to the present exemplary embodiment may be substantially the same as the display device in FIG. 1, except that each pixel includes sub-pixels that emit red, green, blue, and white light.

Referring to FIG. 7, the display panel 100B includes a plurality of pixels, with each pixel including a red color sub-pixel PR, a green color sub-pixel PG, a blue color sub-pixel PB, and a white color sub-pixel PW. The sub-pixels may be arranged in a predetermined pattern, e.g., a stripe pattern or another pattern.

The driver IC chip 300B drives the display panel 100B. In the driver IC chip 300B, a plurality of gamma voltage generators may respectively receive a plurality of reference voltage sets, or some of the gamma voltage generators share a reference voltage set in order to generate one or more gamma voltage sets. The driver IC chip 300B may convert input image data to data signals based on the gamma voltage sets, and then the data signals are output to the sub-pixels.

The power supply 500 may provide at least one reference voltage set to the driver IC chip 300B. In one example embodiment, the power supply 500 may generate a first reference voltage set for red color light, a second reference voltage set for green color light, a third reference voltage set for blue color light, and a fourth reference voltage set for white color light. The first through fourth reference voltage sets may then be provided to the driver IC chip 300B. In another example embodiment, the power supply 500 may generate a fifth reference voltage set for red and green color light and a sixth reference voltage set for blue and white color light. The fifth and sixth reference voltage sets may then be provided to the driver IC chip 300B.

Therefore, in the display device 1000B, the gamma voltage generators respectively receive the reference voltage sets or some of the gamma voltage generators share a reference voltage set to generate the gamma voltage sets. For example, when deviations between or among the gamma voltage sets for the red, green, blue, and white color light are relatively large (e.g., above one or more predetermined values) the display device 1000E may generate the gamma voltage sets using first through fourth reference voltage sets respectively corresponding to the red, green, blue, and white color light. On the other hand, when a first deviation between the gamma voltage sets for the red and green color light and a second deviation between gamma voltage sets for blue and white color light are relatively small (e.g., below one or more predetermined values), the display device 1000B may generate the gamma voltage sets using the fifth reference voltage set corresponding to the red and green color light and the sixth reference voltage set corresponding to the blue and white color light.

Figure 8:
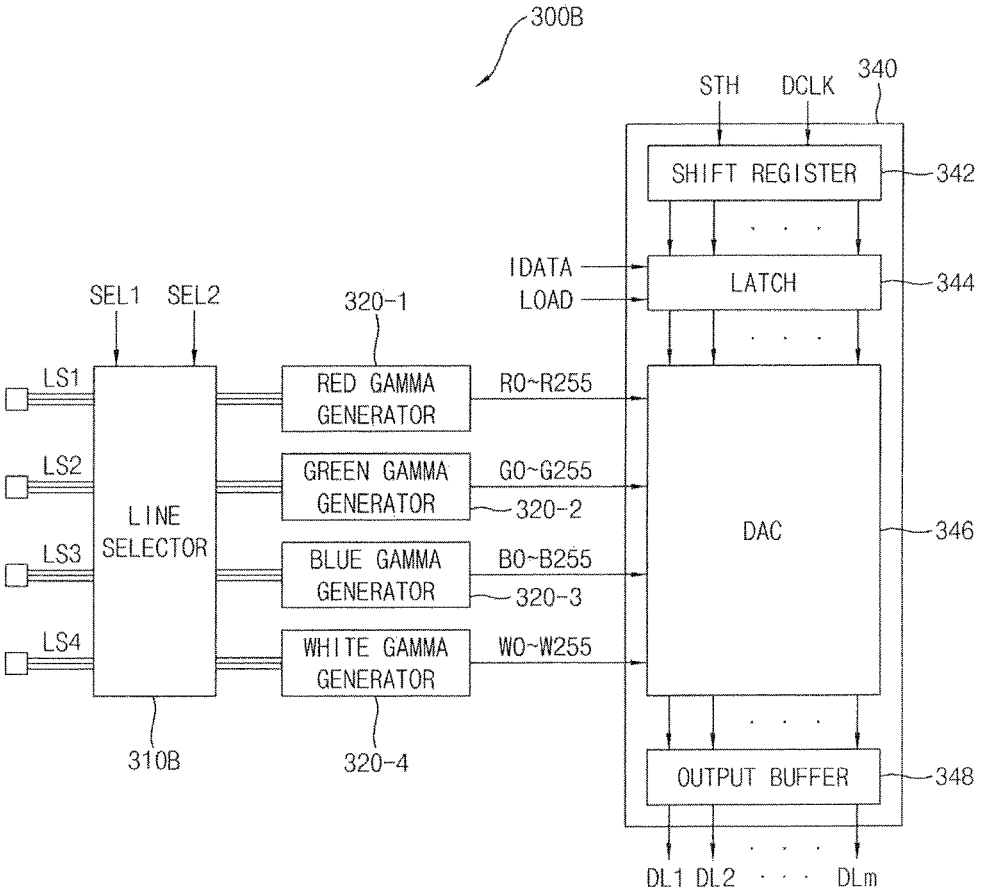
FIG. 8 illustrates another embodiment of a driver IC chip.

FIG. 8 illustrates another embodiment of a driver IC chip 300B, which, for example, may be included in the display device of FIG. 7. Referring to FIG. 8, the driver IC chip 300B may include a line selector 310B, a plurality of gamma voltage generators 320-1 through 320-4, and a data driver 340. The driver IC chip 300B according to the present exemplary embodiment may be substantially the same as the driver IC chip in FIG. 2, except that the fourth voltage generator is added.

The line selector 310B may receive a first selection signal SEL1 and a second selection signal SEL2. The line selector 310B may control the connection between the voltage line sets LS1 through LS4 and the gamma voltage generators 320-1 through 320-4 based on the first selection signal SEL1 and the second selection signal SEL2.

In one example embodiment, the line selector 310B may include a first switch, a second switch, a third switch, and a fourth switch. The first switch is between a first voltage line set LS1 and the second gamma voltage generator 320-2, and may be turned-on in response to the first selection signal SEL1. The second switch is between a second voltage line set LS2 and the second gamma voltage generator 320-2, and may be turned-off in response to the first selection signal SEL1. The third switch is between a third voltage line set LS3 and the fourth gamma voltage generator 320-4, and may be turned-on the second selection signal SEL2. The fourth switch is between a fourth voltage line set LS4 and the fourth gamma voltage generator 320-4, and may be turned-off the second selection signal SEL2.

Each of the gamma voltage generators 320-1 through 320-4 may generate the gamma voltage set based on a reference voltage set. In one example embodiment, the gamma voltage generators 320-1 through 320-4 include the first gamma voltage generator 320-1 for generating a first gamma voltage set R0 through R255 for red color light, a second gamma voltage generator 320-2 for generating a second gamma voltage set G0 through G255 set for a green color light, a third gamma voltage generator 320-3 for generating a third gamma voltage set B0 through B155 for a blue color light, and a fourth gamma voltage generator 320-4 for generating a fourth gamma voltage set W0 through W155 for a white color light.

The data driver 340 may convert input image data to data signals based on the gamma voltage sets. In one example embodiment, the data driver 340 may include a shift register 342, a latch circuit 344, a digital-analog converter 346, and an output buffer 348.

Figure 9A:
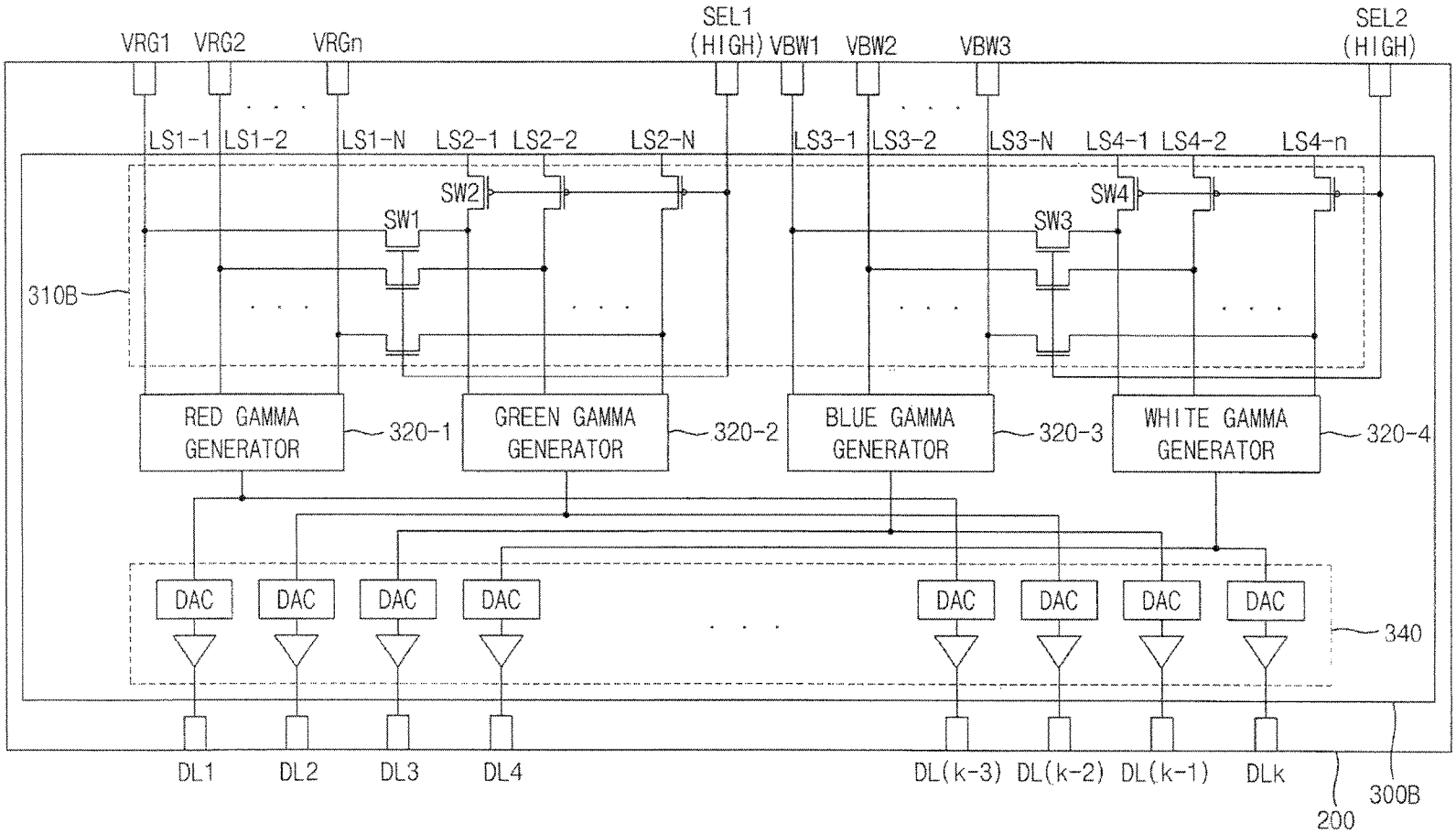
FIGS. 9A-9B illustrate more embodiments of a driver IC chip for a display device.
Figure 9B:
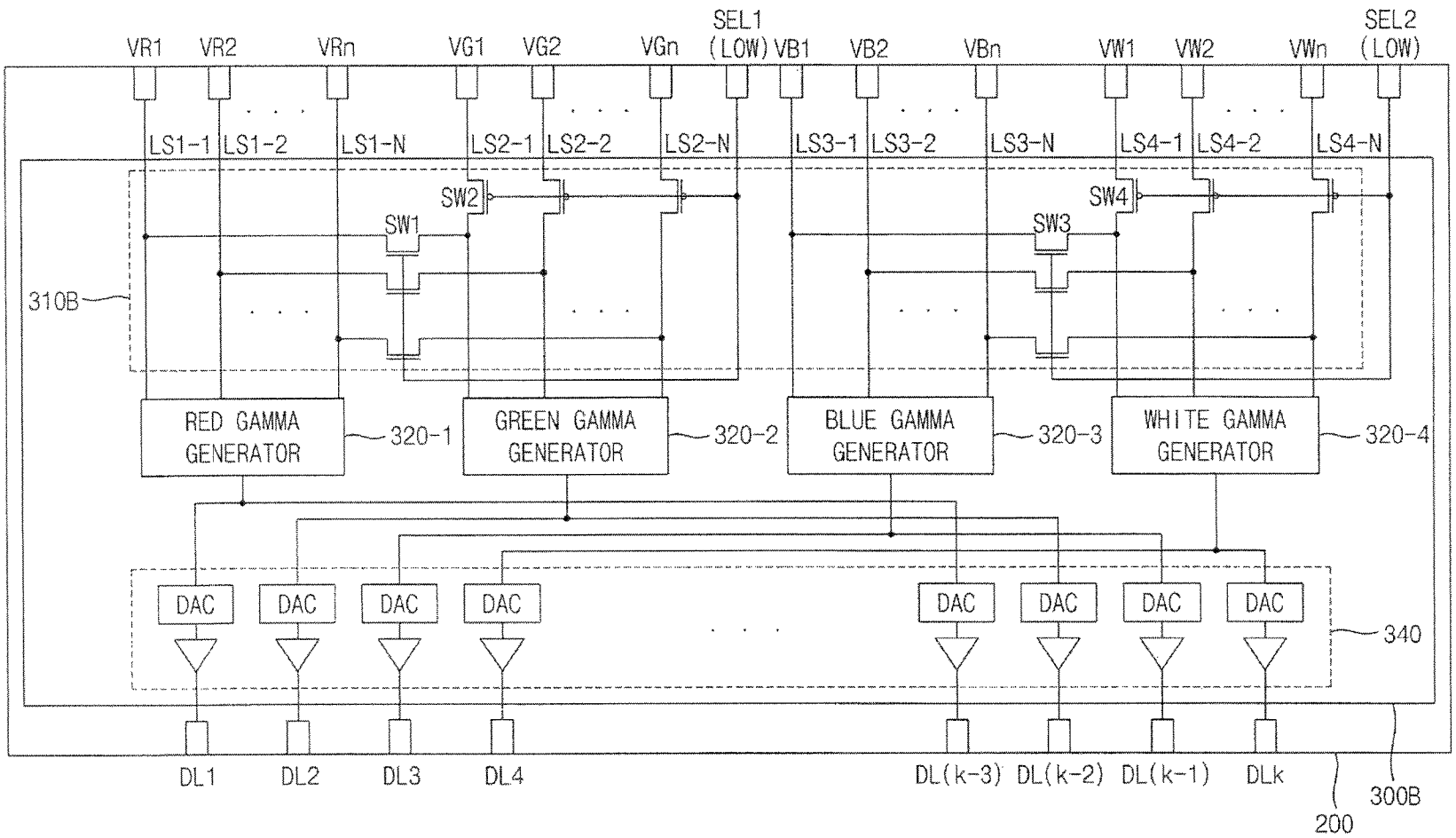

FIGS. 9A and 9B illustrate additional embodiments of the driver IC chip in FIG. 8. Referring to FIGS. 9A and 9B, the driver IC chip 300B may be mounted on the display device providing the reference voltage set in a variety of methods. In one example embodiment, the driver IC chip 300B may be mounted on the display device providing a first reference voltage set VR1 through VRn for red color light, a second reference voltage set VG1 through VGn for green color light, a third reference voltage set VB1 through VBn for blue color light, and a fourth reference voltage set VW1 through VWn for white color light in order to generate gamma voltage sets.

In another example embodiment, the driver IC chip 300B may be mounted on the display device providing a fifth reference voltage set VRG1 through VRGn for red and green color light and a sixth reference voltage set VBW1 through VBWn for blue and white color light in order to generate gamma voltage sets.

As shown in FIG. 9A, the driver IC chip 300B may be mounted on a display device providing the fifth reference voltage set VRG1 through VRGn for red and green color light and the sixth reference voltage set VBW1 through VGWn for blue and white color light in order to generate gamma voltage sets. The driver IC chip 300B may be mounted on the display device, for example, by the COF manner.

The power supply may provide the fifth reference voltage set VRG1 through VRGn and the sixth reference voltage set VBW1 through VBWn to the driver IC chip 300B via a PCB, in which the power supply is formed and a COF film 200 in which the driver IC chip 300B is formed. In this case, the number of reference voltage adhesive pads for bonding the COF film 200 and the PCB may be about two times greater than the number of the reference voltages include in one reference voltage set. For example, the fifth reference voltage set VRG1 through VRGn and the sixth reference voltage set VBW1 through VBWn may respectively include 11 reference voltages. Then, the total number of the reference voltage adhesive pads may be 22.

The line selector 310B may include a first switch SW1, a second switch SW2, a third switch SW3, and a fourth switch SW4. The first switch SW1 may be located between a first voltage line set LS1-1 through LS1-N and the second gamma voltage generator 320-2, and may be turned-on in response to the first selection signal SEL1 The second switch SW2 may be between a second voltage line set LS2-1 through LS2-n and the second gamma voltage generator 320-2, and may be turned-off in response to the first selection signal SEL1 The third switch SW3 may be between a third voltage line set LS3-1 through LS3-N and the fourth gamma voltage generator 320-4, and may be turned-on in response to the second selection signal SEL2. The fourth switching element SW4 may be between a fourth voltage line set LS4-1 through LS4-n and the fourth gamma voltage generator 320-4, and may be turned-off in response to the second selection signal SEL2.

The first selection signal SEL1 may be set to a first level (e.g., a high level) such that the fifth reference voltage set VRG1 through VRGn may be provided to the first gamma voltage generator 320-1 and the second gamma voltage generator 320-2. The second selection signal SEL2 may be set to the first level such that the sixth reference voltage set VBW1 through VBWn may be provided to the third gamma voltage generator 320-3 and the fourth gamma voltage generator 320-4. Accordingly, the first switch SW1 may be turned-on, and the second switch SW2 may be turned-off based on the first selection signal SEL1.

The third switch SW3 may be turned-on and the fourth switch SW4 may be turned-off based on the second selection signal SEL2. Therefore, the line selector 310B may connect the first voltage line set LS1-1 through LS1-N to the first and second gamma voltage generators 320-1 and 320-2. The line selector 310B may disconnect the second voltage line set LS2-1 through LS2-N from the second gamma voltage generator 320-2. Also, the line selector 310B may connect the third voltage line set LS3-1 through LS3-N to the third and fourth gamma voltage generators 320-3 and 320-4. The line selector 310B may disconnect the fourth voltage line set LS4-1 through LS4-N from the fourth gamma voltage generator 320-4.

As shown in FIG. 9B, the driver IC chip 300B may be mounted on a display device providing a first reference voltage set VR1 through VRn for red color light, a second reference voltage set VG1 through VGn for green color light, a third reference voltage set VB1 through VBn for blue color light, and a fourth reference voltage set VW1 through VWn for white color light in order to generate gamma voltage sets. The driver IC chip 300B may be mounted on a display device, for example, by the COF manner.

The power supply may provide the first reference voltage set VR1 through VRn, the second reference voltage set VG1 through VGn, the third reference voltage set VB1 through VBn and, the fourth reference voltage set VW1 through VWn to the driver IC chip 300B via a PCB, in which the power supply is formed and a COF film 200 in which the driver IC chip 300B is formed. In this case, the number of reference voltage adhesive pads for bonding the COF film 200 and the PCB may be about four times greater than the number of the reference voltages in one reference voltage set. For example, the first reference voltage set VR1 through VRn, the second reference voltage set VG1 through VGn, the third reference voltage set VB1 through VBn, and the four reference voltage set VW1 through VWn may respectively include 11 reference voltages. Then, the total number of the reference voltage adhesive pads may be 44.

The line selector 310B may include the first switch SW1, the second switch SW2, the third switch SW3, and the fourth switch SW4. The first selection signal SEL1 may be set to a second level (e.g., a low level) such that the first reference voltage set VR1 through VRn may be provided to the first gamma voltage generator 320-1 and the second reference voltage set VG1 through VGn may be provided to the second gamma voltage generator 320-2. The second selection signal SEL2 may be set to the second level such that the third reference voltage set VB1 through VBn may be provided to the third gamma voltage generator 320-3 and the fourth reference voltage set VW1 through VWn may be provided to the fourth gamma voltage generator 320-4.

Accordingly, the first switch SW1 may be turned-off and the second switch SW2 may be turned-on based on the first selection signal SEL1. The third switching element SW3 may be turned-off and the fourth switching element SW4 may be turned-on based on the second selection signal SEL2. Therefore, the line selector 310B may connect the first voltage line set LS1-1 through LS1-N to the first gamma voltage generator 320-1. The line selector 310B may connect the second voltage line set LS2-1 through LS2-N to the second gamma voltage generator 320-2. The line selector 310B may connect the third voltage line set LS3-1 through LS3-N to the third gamma voltage generator 320-3. The line selector 310B may connect the fourth voltage line set LS4-1 through LS4-N to the fourth gamma voltage generator 320-4.

In one or more of the foregoing embodiments, the line selector performs control so that a first gamma voltage generator corresponding to red color light and a second voltage generator corresponding to green color light share one reference voltage set. Also, the line selector performs control so that first through fourth gamma voltage generators share reference voltage sets in a variety of methods. The embodiments described herein may be applied to an electronic device having the disclosed display device. The electronic device may be, for example, to a cellular phone, a smart phone, a smart pad, a personal digital assistant, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, power supplies, chips, drivers, and other processing features of the disclosed embodiments may be implemented in logic which, for example, may include hardware, software, or both. When implemented at least partially in hardware, the controllers, power supplies, chips, drivers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, power supplies, chips, drivers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, one type of driver IC chip includes a gamma voltage generator that receives a plurality of reference voltage sets via adhesive pads to generate gamma voltage sets for each color of light. However, the number of adhesive pads for bonding a COF film and a PCB is determined according to the predetermined number of reference voltage sets. Thus, the number of adhesive pads is excessive.

In accordance with one or more of the aforementioned embodiments, a driver IC chip includes a line selector for controlling a plurality of gamma voltage generators that respectively receive a plurality of reference voltage sets, or some of the gamma voltage generators share one reference voltage set. Therefore, the driver IC chip may used fewer adhesive pads and/or the adhesive pads may be spaced apart to a greater extent. Such a driver IC chip may be used, for example, for display devices that provide reference voltage sets in various methods. Also, a display device may be provided which is more economical to manufacture and which can prevent bonding defects of adhesive pads from occurring. Such a display device may also improve production yield when some of gamma voltage generators shares the reference voltage set.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments as set forth in the claims.

What is claimed is:

1. A driver integrated circuit (IC) chip, comprising:

a plurality of gamma voltage generators to generate a plurality of gamma voltage sets based on a reference voltage set;

a line selector to control a connection between a plurality of voltage line sets for providing the reference voltage set and the gamma voltage generators, at least two of the gamma voltage generators to share the reference voltage set based on a selection signal; and a data driver to convert input image data to data signals based on the gamma voltage sets, wherein the gamma voltage generators include:

a first gamma voltage generator to generate a first gamma voltage set for first color light;

a second gamma voltage generator to generate a second gamma voltage set for second color light; and a third gamma voltage generator to generate a third gamma voltage set for third color light, and wherein the line selector includes:

a first switch between a first voltage line set of the voltage line sets and the second gamma voltage generator, the first switch to be turned-on in response to the selection signal; and a second switch between a second voltage line set of the voltage line sets and the second gamma voltage generator, the second switch to be turned-off in response to the selection signal.

2. The driver IC chip as claimed in claim 1, wherein the first through third colors of light are red, green, and blue respectively.

3. The driver IC chip as claimed in claim 1, wherein the selection signal is included in protocol data for receiving the input image data.

4. A driver integrated circuit (IC) chip, comprising:

a plurality of gamma voltage generators to generate a plurality of gamma voltage sets based on a reference voltage set;

a line selector to control a connection between a plurality of voltage line sets for providing the reference voltage set and the gamma voltage generators, at least two of the gamma voltage generators to share the reference voltage set based on a selection signal; and a data driver to convert input image data to data signals based on the gamma voltage sets, wherein the gamma voltage generators include:

a first gamma voltage generator to generate a first gamma voltage set for first color light;

a second gamma voltage generator to generate a second gamma voltage set for second color light;

a third gamma voltage generator to generate a third gamma voltage set for third color light; and a fourth gamma voltage generator to generate a fourth gamma voltage set for fourth color light, and wherein the line selector includes:

a first switch between a first voltage line set of the voltage line sets and the second gamma voltage generator, the first switch to be turned-on in response to a first selection signal;

a second switch between a second voltage line set of the voltage line sets and the second gamma voltage generator, the second switch to be turned-off in response to the first selection signal;

a third switch between a third voltage line set of the voltage line sets and the fourth gamma voltage generator, the third switch to be turned-on a second selection signal; and a fourth switch between a fourth voltage line set of the voltage line sets and the fourth gamma voltage generator, the fourth switch to be turned-off the second selection signal.

5. The driver IC chip as claimed in claim 4, wherein the first through fourth colors of light are red, green, blue, and white respectively.

6. A display device, comprising:

a display panel including a plurality of pixels;

a driver integrated circuit (IC) chip to drive the display panel; and a power supply to provide at least one reference voltage set to the driver IC chip, wherein the driver IC chip includes:

a plurality of gamma voltage generators to generate a plurality of gamma voltage sets based on the reference voltage set;

a line selector to control a connection between a plurality of voltage line sets for providing the reference voltage set and the gamma voltage generators, at least two of the gamma voltage generators to share the reference voltage set based on a selection signal; and a data driver to convert input image data to a data signal based on the gamma voltage sets, wherein the gamma voltage generators include:

a first gamma voltage generator to generate a first gamma voltage set for first color light;

a second gamma voltage generator to generate a second gamma voltage set for second color light; and a third gamma voltage generator to generate a third gamma voltage set for third color light, and wherein the line selector includes:

a first switch between a first voltage line set of the voltage line sets and the second gamma voltage generator, the first switch to be turned-on in response to the selection signal; and a second switch between a second voltage line set of the voltage line sets and the second gamma voltage generator, the second switch to be turned-off in response to the selection signal.

7. The display device as claimed in claim 6, wherein:

the power supply is on a printed circuit board (PCB), and the driver IC chip is connected to the display panel and the PCB by a tape carrier package (TCP) manner or a chip-on-film (COF) manner.

8. The display device as claimed in claim 7, wherein:

a provision voltage line set connected to the gamma voltage generators among the voltage line sets is bonded to the PCB, and a non-provision voltage line set disconnected from the gamma voltage generators among the voltage line sets is not bonded to the PCB.

9. The display device as claimed in claim 6, wherein the first through third colors of light are red, green, and blue respectively.

10. The display device as claimed in claim 6, wherein each of the gamma voltage generators includes a resistance string to generate one of the gamma voltage sets by distributing the reference voltage set.

11. A display device, comprising:

a display panel including a plurality of pixels;

a driver integrated circuit (IC) chip to drive the display panel; and a power supply to provide at least one reference voltage set to the driver IC chip, wherein the driver IC chip includes:

a plurality of gamma voltage generators to generate a plurality of gamma voltage sets based on the reference voltage set;

a line selector to control a connection between a plurality of voltage line sets for providing the reference voltage set and the gamma voltage generators, at least two of the gamma voltage generators to share the reference voltage set based on a selection signal; and a data driver to convert input image data to a data signal based on the gamma voltage sets, wherein the gamma voltage generators include:

a first gamma voltage generator to generate a first gamma voltage set for first color light;

a second gamma voltage generator to generate a second gamma voltage set for second color light;

a third gamma voltage generator to generate a third gamma voltage set for third color light; and a fourth gamma voltage generator to generate a fourth gamma voltage set for fourth color light, and wherein the line selector includes:

a first switch between a first voltage line set of the voltage line sets and the second gamma voltage generator, the first switch to be turned-on in response to a first selection signal;

a second switch between a second voltage line set of the voltage line sets and the second gamma voltage generator, the second switch to be turned-off in response to the first selection signal;

a third switch between a third voltage line set of the voltage line sets and the fourth gamma voltage generator, the third switch to be turned-on a second selection signal; and a fourth switch between a fourth voltage line set of the voltage line sets and the fourth gamma voltage generator, the fourth switch to be turned-off the second selection signal.

12. The display device as claimed in claim 11, wherein the first through fourth colors of light are red, green, blue, and white respectively.

13. The display device as claimed in claim 6, wherein the selection signal is included in protocol data for receiving the input image data.

* * * * *